US006932897B2

(12) United States Patent
Burca et al.

(10) Patent No.: US 6,932,897 B2
(45) Date of Patent: Aug. 23, 2005

(54) TITANIUM-CONTAINING METALS WITH ADHERENT COATINGS AND METHODS FOR PRODUCING SAME

(75) Inventors: Florin Burca, Kitchener (CA); John Darmon, Guelph (CA)

(73) Assignee: Com Dev Ltd., Cambridge (CA)

( * ) Notice: Subject to any disclaimer, the term of this patent is extended or adjusted under 35 U.S.C. 154(b) by 151 days.

(21) Appl. No.: 10/376,502

(22) Filed: Mar. 3, 2003

(65) Prior Publication Data

US 2004/0173466 A1 Sep. 9, 2004

(51) Int. Cl.[7] ..... C25D 5/38; C25D 5/30; C25D 5/18; C23C 28/00; B05D 3/02

(52) U.S. Cl. ..... 205/212; 205/102; 205/191; 205/228; 427/376.8; 427/405; 427/436; 427/437

(58) Field of Search ..... 427/376.8, 383.7, 427/436, 405, 437; 428/615; 205/212, 228, 191, 102

(56) References Cited

U.S. PATENT DOCUMENTS

| | | | | |
|---|---|---|---|---|
| 4,101,386 A | | 7/1978 | Dötzer et al. | |
| 4,221,845 A | | 9/1980 | Koehler | |
| 4,416,739 A | | 11/1983 | Turner | |
| 4,525,250 A | | 6/1985 | Fahrmbacher-Lutz et al. | |
| 4,588,480 A | | 5/1986 | Thoma | |
| 4,655,884 A | | 4/1987 | Hills et al. | |
| 4,902,388 A | | 2/1990 | Fornwalt et al. | |
| 4,904,352 A | | 2/1990 | Witte | |
| 4,938,850 A | | 7/1990 | Rothschild et al. | |
| RE33,800 E | | 1/1992 | Fornwalt et al. | |
| 5,116,430 A | | 5/1992 | Hirai et al. | |
| 5,464,524 A | | 11/1995 | Ogiwara et al. | |
| 5,858,557 A | * | 1/1999 | Yoon et al. | 428/672 |
| 6,039,860 A | | 3/2000 | Cooper et al. | |

FOREIGN PATENT DOCUMENTS

| | | | | |
|---|---|---|---|---|
| JP | 05320982 A | * | 12/1993 | C25D/5/38 |
| JP | 08176852 A | * | 7/1996 | C23F/1/26 |

OTHER PUBLICATIONS

Horn, "Pulse Plating", Dynatronix, no date.*

* cited by examiner

*Primary Examiner*—Edna Wong
(74) *Attorney, Agent, or Firm*—Bereskin & Parr; Isis E. Caulder

(57) ABSTRACT

A method for plating a titanium-containing metal, comprising the steps of: (a) surface treating the titanium-containing metal in a solution consisting essentially of an aqueous solvent and hydrochloric acid for a period of time sufficient to activate the surface of the titanium-containing metal; (b) plating the surface of the surface treated titanium-containing metal with a metallic coating in an electrolyte bath; and (c) non-oxidatively heat treating the plated titanium-containing metal for a period of time sufficient to cause diffusion bonding between the metallic coating and the titanium-containing metal. The present invention also provides parts made in accordance with the methods disclosed herein.

35 Claims, No Drawings

TITANIUM-CONTAINING METALS WITH ADHERENT COATINGS AND METHODS FOR PRODUCING SAME

FIELD OF THE INVENTION

The present invention relates to titanium-containing metals with adherent metal coatings, and to methods for producing same.

BACKGROUND OF THE INVENTION

Titanium-containing metals are of great interest to the aerospace industry because they have low densities, low thermal expansion coefficients, and high structural strengths. Parts made from titanium-containing metals are lightweight, and can withstand high thermal stresses and high physical loads.

In some applications, it is desirable to deposit a metallic coating onto the surface of the part. However, the part rapidly oxidizes when exposed to oxygen to create an oxide layer that is electrically and chemically passive in nature. The presence of this passive oxide layer severely inhibits the chemical bonding that takes place between the metallic coating and the part. As a result, it is extremely difficult to deposit an adherent metal coating onto the part. Even when the metallic coating is successfully deposited onto the oxide layer of the part, adhesion tends to be poor. Consequently, the metallic coating is of little value since it can be removed from the surface of the part by bending, peeling and/or scratching.

Aggressive pretreatments including the use of harsh etchants (i.e., high concentrations of chromic acid, nitric acid, sulfuric acid, glacial acetic or any combinations thereof) are commonly used to remove the passive oxide layer from the surface of the part prior to depositing the metallic coating. However, these harsh etchants cannot be used on precision electronic aerospace parts because these parts have tight tolerances and prescribed surface finishes. Moreover, the harsh etchants are harmful to humans and to the environment.

SUMMARY OF THE INVENTION

In one aspect, the present invention provides for a method for plating a titanium-containing metal, comprising the steps of:

a) surface treating the titanium-containing metal in a solution consisting essentially of an aqueous solvent and hydrochloric acid for a period of time sufficient to activate the surface of the titanium-containing metal;

b) plating the surface of the surface treated titanium-containing metal with a metallic coating in an electrolyte bath by applying a first voltage to impart a first electric current for a first period of time sufficient to plate a thin metallic coating onto the surface of the surface treated titanium-containing metal followed by applying a second voltage, lower than the first voltage, to impart a second electric current for a second period of time, longer than the first period of time, sufficient to build up the thickness of the thin metallic coating to a desired thickness; and c) non-oxidatively heat treating the plated titanium-containing metal for a period of time sufficient to cause diffusion bonding between the metallic coating and the titanium-containing metal.

In another aspect, the present invention provides for a method for plating a titanium-containing metal, comprising the steps of:

a) surface treating the titanium-containing metal in a solution consisting essentially of an aqueous solvent, hydrochloric acid, and fluoboric acid for a period of time sufficient to activate the surface of the titanium-containing metal;

b) plating the surface of the surface treated titanium-containing metal with a metallic coating in an electrolyte bath by applying a first voltage to impart a first electric current for a first period of time sufficient to plate a thin metallic coating onto the surface of the surface treated titanium-containing metal followed by applying a second voltage, lower than the first voltage, to impart a second electric current for a second period of time, longer than the first period of time, sufficient to build up the thickness of the thin metallic coating to a desired thickness; and c) non-oxidatively heat treating the plated titanium-containing metal for a period of time sufficient to cause diffusion bonding between the metallic coating and the titanium-containing metal.

In another aspect, the present invention provides for a method for plating a titanium-containing metal, comprising the steps of:

a) surface treating the titanium-containing metal in a solution for a period of time sufficient to activate the surface of the titanium-containing metal;

b) plating the surface of the surface treated titanium-containing metal with a first metallic coating in a first electrolyte bath;

c) non-oxidatively heat treating the first plated titanium-containing metal for a period of time sufficient to cause diffusion bonding between the first metallic coating and the titanium-containing metal;

d) electroless plating the non-oxidatively heat treated titanium-containing metal with a second metallic coating in a second electrolyte bath; and e) heat treating the second plated titanium-containing metal for a period of time sufficient to promote adhesion between the second metallic coating and the first metallic coating.

In another aspect, the present invention provides for a part comprising a titanium-containing metal having an adherent metal coating when made by a method in accordance with the present invention, comprising the steps of:

a) surface treating the titanium-containing metal in a solution consisting essentially of an aqueous solvent and hydrochloric acid for a period of time sufficient to activate the surface of the titanium-containing metal;

b) plating the surface of the surface treated titanium-containing metal with a metallic coating in an electrolyte bath; and c) non-oxidatively heat treating the plated titanium-containing metal for a period of time sufficient to cause diffusion bonding between the metallic coating and the titanium-containing metal.

In another aspect, the present invention provides for a part comprising a titanium-containing metal having an adherent metal coating when made by a method in accordance with the present invention, comprising the steps of:

a) surface treating the titanium-containing metal in a solution consisting essentially of an aqueous solvent, hydrochloric acid, and fluoboric acid for a period of time sufficient to activate the surface of the titanium-containing metal;

b) plating the surface of the surface treated titanium-containing metal with a metallic coating in an electrolyte bath; and c) non-oxidatively heat treating the plated titanium-containing metal for a period of time sufficient to cause diffusion bonding between the metallic coating and the titanium-containing metal.

In another aspect, the present invention provides for a part comprising a titanium-containing metal having an adherent metal coating when made by a method in accordance with the present invention, comprising the steps of:

a) surface treating the titanium-containing metal in a solution consisting essentially of an aqueous solvent and hydrochloric acid for a period of time sufficient to activate the surface of the titanium-containing metal;

b) plating the surface of the surface treated titanium-containing metal with a first metallic coating in a first electrolyte bath;

c) non-oxidatively heat treating the first plated titanium-containing metal for a period of time sufficient to cause diffusion bonding between the first metallic coating and the titanium-containing metal;

d) electroless plating the non-oxidatively heat treated titanium-containing metal with a second metallic coating in a second electrolyte bath; and e) heat treating the second plated titanium-containing metal for a period of time sufficient to promote adhesion between the second metallic coating and the first metallic coating.

DETAILED DESCRIPTION OF THE INVENTION

The methods in accordance with the present invention can be applied to any type of titanium-containing metal well known in the art. Examples of titanium-containing metals include, but are not limited to, (a) commercially pure titanium, (b) an alloy of 5 weight percent aluminum, 2.5 weight percent tin, and 92.5 weight percent titanium, and (c) an alloy of 6 weight percent aluminum, 4 weight percent vanadium, and 90 weight percent titanium (Ti-6Al-4V).

The methods in accordance with the present invention can be applied to treat titanium-containing metal parts with intricate geometries (i.e., parts with curved surfaces, recessed areas, and/or internal surfaces). An example of this type of part includes, but is not limited to, waveguide manifolds for multiplexer assemblies. In its preferred form, the present invention can be applied to treat titanium-containing metal parts with relatively flat geometries (i.e., parts with a limited number of curved surfaces, recessed areas, and internal surfaces). Examples of these types of parts include, but are not limited to, screws, pedestals, and resonators.

A method for plating a titanium-containing metal with an adherent metallic coating in accordance with a first embodiment of the present invention is described below.

The surface of the titanium-containing metal can be cleaned to remove grease, dirt, and other physical contaminants. The cleaning step(s) are not limited to any specific method(s), and may include any method well known in the art.

The cleaning step(s) can include, for example, an ultrasonic alkaline cleaning step followed by an anodic electroclean step in an alkaline solution. Ultrasonic agitation of the titanium-containing metal in the cleaner increases the efficiency of the removal of grease, dirt and other physical contaminants from the surface of the titanium-containing metal. The anodic electroclean step is a type of micro-scale cleaning. In this example, the titanium-containing metal is treated in an ultrasonic alkaline cleaner comprising an aqueous ethoxylated alcohol solution (e.g., 3% v/v Cleanaire 1200™ which is commercially available from Rochester Midland) at a temperature of about 25° C. to about 90° C., more preferably about 50° C. to about 70° C., and most preferably about 60° C. for about 1 minute to about 60 minutes, more preferably about 10 minutes to about 20 minutes, and most preferably about 15 minutes. Next, the titanium-containing metal is treated with an anodic electroclean in an alkaline solution comprising sodium hydroxide, silicic acid, and carbonic acid (e.g., 62.5 g/L Electromet™ which is commercially available from Atotech) at a temperature of about 50° C. to about 95° C., more preferably about 50° C. to about 70° C., and most preferably about 60° C. and a voltage is applied to impart an electric current that results in a current density of about 20 amperes per square foot to about 80 amperes per square foot, more preferably about 45 amperes per square foot to about 55 amperes per square foot, and most preferably about 50 amperes per square foot for about 15 seconds to about 600 seconds, more preferably about 30 seconds to about 90 seconds, and most preferably about 60 seconds. After each cleaning step, the titanium-containing metal is rinsed with an appropriate rinsing agent, for example, deionized water, to remove any residual solution.

Next, the surface of the titanium-containing metal can be chemically cleaned and activated in a solution. Ultrasonic agitation of the titanium-containing metal in the solution helps to increase the efficiency of the treatment in removing oxides from the surface of the titanium-containing metal. This activation step enhances adhesion between the surface of the titanium-containing metal and the first metallic coating that is subsequently applied. After the activation step, the titanium-containing metal is rinsed with an appropriate rinsing agent, for example, deionized water, to remove any residual solution.

In one aspect of the invention, the solution comprises about 5 mol/L hydrochloric acid to about 15 mol/L hydrochloric acid, more preferably the solution comprises about 8 mol/L hydrochloric acid to about 12 mol/L hydrochloric acid, and most preferably the solution comprises about 10.2 mol/L hydrochloric acid. Preferably, the titanium-containing metal is immersed in the solution for about for about 2 minutes to about 15 minutes, more preferably about 5 minutes to about 10 minutes, and most preferably about 6 minutes.

In another aspect of the invention, the solution comprises about 7.1 mol/L to about 9.7 mol/L hydrochloric acid and about 0.5 mol/L to about 3.1 mol/L fluoboric acid, more preferably the solution comprises about 7.6 mol/L to about 8.7 mol/L hydrochloric acid and about 1.6 mol/L to about 2.6 mol/L fluoboric acid, and most preferably the solution comprises about 8.1 mol/L hydrochloric acid and about 2.1 mol/L fluoboric acid. Preferably, the titanium-containing metal is immersed in the solution for about 1 minute to about 15 minutes, more preferably about 2 minutes to about 5 minutes, and most-preferably about 3 minutes. The acid acts as a buffer or pH stabilizer in the solution to temper the strength of the hydrochloric acid.

Next, the surface is rinsed with a suitable rinsing agent, for example, deionized water, to remove any residual solution. The surface of the surface-treated titanium-containing metal is plated with a first metallic coating in a first electrolyte bath. This plating step is achieved by providing an electrochemical cell comprising the first electrolyte bath, an anode and a cathode comprising the titanium-containing metal. A preferred first electrolyte bath comprises nickel sulfamate, nickel chloride and boric acid and is commonly referred to as a Sulfamate bath. A preferred anode comprises nickel. The first electrolyte bath can contain, for example, about 300 g/L to about 375 g/L nickel sulfamate, about 7 g/L to about 23 g/L nickel chloride, and about 30 g/L to about 45 g/L boric acid. In this context, the first metallic coating comprises nickel. Preferably, the pH of the first electrolyte bath is about 3 to about 5, more preferably about 3.5 to about 4.5, and most preferably about 4. Alternatively, the first electrolyte bath can be a Woods nickel bath comprising nickel chloride and hydrochloric acid.

In one aspect of the invention, the plating step is performed by applying a voltage to impart an electric current for a period of time sufficient to deposit the first metallic coating to a desired thickness.

In its preferred form, the plating step is performed by applying a first voltage to impart a first electric current for a first period of time followed by a second voltage to impart a second electric current for a second period of time under conditions sufficient to deposit the first metallic coating to a desired thickness. The thickness of the first metallic coating is not critical, but can range for example between about 1.5 $\mu$m to about 2.5 $\mu$m. The first voltage is relatively high and is applied for a relatively short period of time to provide a thin seed layer of the first metallic coating on the surface of the surface-treated titanium-containing metal. The second voltage is relatively low and is applied for a relatively long period of time to build up the thickness of the first metallic coating. The application of the second voltage allows the first metallic coating to be uniformly distributed on the surface of the titanium-containing metal since the plating bath behaves more predictably at lower voltages.

Preferably, the first electric current results in a first current density of about 30 amperes per square foot to about 60 amperes per square foot, more preferably about 40 amperes per square foot to about 55 amperes per square foot, and most preferably about 50 amperes per square foot and the voltage is applied for about 2 minutes to about 10 minutes, more preferably about 3 minutes to about 6 minutes, and most preferably about 5 minutes. Preferably, the second electric current results in a second current density of about 5 amperes per square foot to about 50 amperes per square foot, more preferably about 15 amperes per square foot to about 25 amperes per square foot, and most preferably about 20 amperes per square foot and the voltage is applied for about 5 minutes to about 45 minutes, more preferably about 15 minutes to about 35 minutes, and most preferably about 25 minutes. Preferably, the second electrolyte bath is heated to a temperature of about 40° C. to about 60° C., more preferably about 45° C. to about 55° C., and most preferably about 49° C.

After the first metallic coating has been applied on the surface of the surface treated titanium-containing metal, the titanium-containing metal may be rinsed with a suitable rinsing agent, for example, deionized water, to remove any residual electroplating bath.

Next, the first plated titanium-containing metal is non-oxidatively heat-treated at a temperature and for a period of time sufficient to cause diffusion bonding between the first metallic coating and the titanium-containing metal. Preferably, the first struck titanium-containing metal is non-oxidatively heat-treated at a temperature of about 300° C. to about 700° C., more preferably about 475° C. to about 500° C., and most preferably about 500° C. for about 1 hours to about 16 hours, more preferably about 3 hours to about 8 hours, and most preferably 5 hours.

In the non-oxidative heat-treating step, a titanium alloy layer is formed between the first metallic coating and the titanium-containing metal. This titanium alloy layer results in a close and firm adherence of the first metallic coating to the titanium-containing metal.

In one aspect of the invention, the non-oxidative heat-treating step is carried out under a vacuum pressure of about $10^{-5}$ millitor. In another aspect of the invention, the non-oxidative heat-treating step is carried out in an inert or reductive gas atmosphere comprising at least one member selected from the group consisting of nitrogen, argon and hydrogen.

In some instances, it may be desirable to electroplate one or more metallic coatings onto the surface of the heat treated titanium-containing metal. The metallic coatings may be chosen from a wide variety of metals, including, but not limited to: copper, silver, gold or rhodium. The composition of the electrolyte bath(s), the current densities applied, and the lengths of time the current is imparted to the surface of the titanium-containing metal will all depend on the metallic coating and the desired thickness. The metallic coatings may be applied by any plating method that is well known to a person skilled in the art.

By way of example only, a second metallic coating can be applied by providing an electrochemical cell comprising a second electrolyte bath, an anode and a cathode comprising the titanium-containing metal. A preferred second electrolyte bath comprises copper sulfate, sulfuric acid, and hydrochloric acid and is commonly referred to as an acid copper bath. A preferred anode comprises copper. In this context, the second metallic coating comprises copper. The second metallic coating can be applied under bath concentrations and operating conditions that are well known to a person skilled in the art.

The electroplating is performed by applying a voltage to impart an electric current for a period of time sufficient to deposit the second metallic coating to a desired thickness. The thickness of the second metallic coating is not critical. Preferably, the electric current results in a current density of about 3 amperes per square foot to about 10 amperes per square foot, more preferably about 4 amperes per square foot to about 6 amperes per square foot, and most preferably about 5 amperes per square foot. Preferably, the voltage is applied for about 15 minutes to about 60 minutes, more preferably about 25 minutes to about 40 minutes, and most preferably about 30 minutes. Preferably, the second electrolyte bath is heated to a temperature of about 40° C. to about 60° C., more preferably about 45° C. to about 55° C., and most preferably about 49° C.

By way of example only, a third metallic coating can be applied by providing an electrochemical cell comprising a third electrolyte bath, an anode and a cathode comprising the titanium-containing metal. A preferred fifth electrolyte bath comprises silver, and is commonly referred to as an alkaline (cyanide) silver bath. A preferred anode comprises silver. In this context, the third metallic coating comprises silver. The third metallic coating can be applied under bath concentrations and operating conditions that are well known to a person skilled in the art.

The electroplating is performed by applying a voltage to impart an electric current for a period of time sufficient to deposit the third metallic coating to a desired thickness. The thickness of the third metallic coating is not critical. Preferably, the electric current results in a current density of about 2 amperes per square foot to about 15 amperes per square foot, more preferably about 3 amperes per square foot to about 10 amperes per square foot, and most preferably about 4.25 amperes per square foot. Preferably, the voltage is applied for about 15 minutes to about 60 minutes, more preferably about 25 minutes to about 40 minutes, and most preferably about 30 minutes. Preferably, the third electrolyte bath is heated to a temperature of about 20° C. to about 40° C., more preferably about 25° C. to about 35° C., and most preferably about 30° C.

A method for plating a titanium-containing metal with an adherent metallic coating in accordance with a second embodiment of the present invention is described below. This method is preferably used when the plated titanium-containing metal parts need to have high wear resistance and high corrosion resistance.

All of the steps prior to the first plating step, including the cleaning steps and the surface activation step are identical to the first embodiment and will not be described again.

The first plating step is similar to the first embodiment, with the exception of the magnitudes of the voltages and the period of times that the voltages are applied to the surface of the surface treated titanium-containing metal. Specifically, the voltages and the period of times and chosen to provide a thinner first metallic coating as compared to the first metallic coating applied in the first embodiment.

The surface-treated titanium-containing metal is plated with a first metallic coating in a first electrolyte bath. This plating step is achieved by providing an electrochemical cell comprising the first electrolyte bath, an anode and a cathode comprising the titanium-containing metal. A preferred first electrolyte bath comprises nickel sulfamate, nickel chloride and boric acid and is commonly referred to as a Sulfamate bath. A preferred anode comprises nickel. The first electrolyte bath can contain, for example, about 300 g/L to about 375 g/L nickel sulfamate, about 7 g/L to about 23 g/L nickel chloride, and about 30 g/L to about 45 g/L boric acid. In this context, the first metallic coating comprises nickel. Preferably, the pH of the first electrolyte bath is about 3 to about 5, more preferably about 3.5 to about 4.5, and most preferably about 4. Alternatively, the first electrolyte bath can be a Woods nickel bath comprising nickel chloride and hydrochloric acid.

In one aspect of the invention, the plating step is performed by applying a voltage to impart an electric current for a period of time sufficient to deposit the first metallic coating to a desired thickness.

In its preferred form, the plating step is performed by applying a first voltage to impart a first electric current for a first period of time followed by a second voltage to impart a second electric current for a second period of time under conditions sufficient to deposit the first metallic coating to a desired thickness. The thickness of the first metallic coating is not critical, but can range for example between about 1.5 $\mu$m to about 2.5 $\mu$m. The first voltage is relatively high and is applied for a relatively short period of time to provide a thin seed layer of the first metallic coating on the surface of the surface-treated titanium-containing metal. The second voltage is relatively low and is applied for a relatively long period of time to build up the thickness of the first metallic coating. The application of the second voltage allows the first metallic coating to be uniformly distributed on the surface of the titanium-containing metal since the plating bath behaves more predictably at lower voltages.

Preferably, the first electric current results in a first current density of about 30 amperes per square foot to about 80 amperes per square foot, more preferably about 40 amperes per square foot to about 55 amperes per square foot, and most preferably about 50 amperes per square foot and the voltage is applied for about 2 minutes to about 10 minutes, more preferably about 3 minutes to about 6 minutes, and most preferably about 5 minutes. Preferably, the second electric current results in a second current density of about 5 amperes per square foot to about 35 amperes per square foot, more preferably about 15 amperes per square foot to about 25 amperes per square foot, and most preferably about 20 amperes per square foot and the voltage is applied for about 5 minutes to about 20 minutes, more preferably about 7 minutes to about 15 minutes, and most preferably about 10 minutes. Preferably, the first electrolyte bath is heated to a temperature of about 40° C. to about 60° C., more preferably about 45° C. to about 55° C., and most preferably about 49° C.

The non-oxidative heat treating step is identical to the first embodiment and will not be repeated again.

Next, the titanium-containing metal is electroless plated with a second metallic coating in a second electrolyte bath. The purpose of this electroless plating step is to provide a uniform layer of metal with a constant thickness and a relatively high resistance to both wear and corrosion. When the parts are used in electronic aerospace applications such as in a multiplexer assembly, it is preferable to have a metallic coating with a uniform thickness to ensure that the high frequency electromagnetic signals are properly propagated through the part.

This electroless plating step is achieved by submersing the piece of titanium-containing metal into the second electrolyte bath. A preferred second electrolyte bath comprises nickel phosphorous (e.g., 6 g/L of Ni via En 3500™ which is commercially available from Technic). In this context, the second metallic coating comprises nickel. Preferably, the pH of the second electrolyte bath is about 4 to about 5, more preferably about 4.5 to about 4.9, and most preferably about 4.6.

The electroless plating step is performed by submersing the titanium-containing metal into the second electrolyte bath under conditions and for period of time sufficient to deposit the third nickel coating to a desired thickness. The thickness of the second metallic coating is not critical, but can range for example between about 1.5 $\mu$m to about 7.5 $\mu$m. Preferably, the titanium-containing metal remains in the electrolyte bath for about 10 minutes to about 60 minutes, more preferably about 20 minutes to about 40 minutes, and most preferably about 30 minutes. Preferably, the second electrolyte bath is heated to a temperature of about 75° C. to about 95° C., more preferably about 80° C. to about 90° C., and most preferably about 85° C. This electroless plating step ensures that the second metallic coating is evenly applied to the surface of the titanium-containing metal.

Next, the second plated titanium-containing metal may be heat treated at a temperature and for a period of time sufficient to promote adhesion between the second metallic coating and the first metallic coating. Moreover, this heating step increases the hardness of the second metallic coating and the first metallic coating. This enhances adhesion of a subsequently applied metallic coating. Additionally, this heating step forces hydrogen out of the second metallic coating, which in effect reduces hydrogen embrittlement that might otherwise occur if the coating is left untreated.

The second plated titanium-containing metal may be heat treated at a temperature of about 100° C. to about 500° C., more preferably about 120° C. to about 200° C., and most preferably about 125° C. for about 1 hours to about 4 hours, more preferably about 1.5 hour to about 3 hours, and most preferably 2 hours.

In some instances, it may be desirable to electroplate one or more additional metallic coatings onto the surface of the heat treated titanium-containing metal. The additional metallic coatings may be chosen from a wide variety of metals, including, but not limited to: copper, silver, gold or rhodium. The composition of the electrolyte bath(s), the current densities applied, the lengths of time the current is imparted to the surface of the titanium-containing metal will all depend on the metallic coating(s) chosen and the desired thicknesses. The metallic coatings may be applied by any plating method that is well known to a person skilled in the art.

By way of example only, a copper coating followed by a silver coating may be applied to the titanium-containing metal.

The following non-limiting example is illustrative of the present invention:

EXAMPLE 1

A titanium-containing metal screw consisting of 6AL-4V-Ti alloy was plated by the following steps.

(1) Cleaning Steps (i) ultrasonic alkaline cleaning step with an aqueous ethoxylated alcohol solution (e.g., 3% v/v Cleanaire 1200™ which is commercially available from Rochester Midland) for 15 minutes at a temperature of about 60° C.;

(ii) single rinse with deionized water at room temperature;

(iii) anodic electroclean in an alkaline solution comprising sodium hydroxide, silicic acid, and carbonic acid (i.e., 62.5 g/L Electromet™ which is commercially available from Atotech) at a temperature of about 82° C. with a current density of about 50 amperes per square foot for about 1 minute; and (iv) double rinse with deionized water at room temperature.

(2) Surface Activation Step (i) pickling in an aqueous solution containing 10.1 mol/L hydrochloric acid at room temperature for 6 minutes; and (ii) single rinse with deionized water at room temperature.

(3) Plating to Provide a Nickel First Coating

The plating step was carried out by an electroplating method in a Sulfamate bath under the following conditions listed below. The Sulfamate electrolyte bath was comprised of between about 300 g/L to about 375 g/L nickel sulfamate, about 7 g/L to about 23 g/L nickel chloride, and about 30 g/L tp about 45 g/L boric acid, and the treatment was carried out at 49° C.

(i) plating with nickel was carried out at a first current density of 50 amperes per square foot for about 5 minutes and a second current density of 20 amperes per square foot for about 25 minutes to deposit a nickel first coating;

(ii) double rinse with deionized water at room temperature.

(4) Non-oxidative Heat Treating Step

The titanium-containing metal was heated at a temperature of 500° C. for 5 hours under a vacuum pressure of $10^{-5}$ millitor.

(5) Cleaning Steps (i) single rinse with deionized water at room temperature;

(ii) anodic electroclean in an alkaline solution comprising sodium hydroxide, silicic acid, and carbonic acid (e.g., 62.5 g/L Electromet™ which is commercially available from Atotech at a temperature of about 82° C. with a current density of about 20 amperes per square foot for about 1 minute;

(iii) double rinse with deionized water at room temperature;

(iv) desmut in a conventional solution for 2 minutes at room temperature to remove organics;

(v) drag-out; and (vi) double rinse with deionized water at room temperature.

(6) Surface Activation Step (i) pickling in an aqueous solution containing sodium fluoride (e.g., 46 g/L Tas 3z™ which is commercially available from Technic) at room temperature for 2 minutes;

(ii) drag-out; and (iii) double rinse with deionized water at room temperature.

(7) Strike Plating Step to Provide a Copper Second Coating

The strike plating step was carried out by an electroplating method in a copper cyanide bath under the following conditions listed below.

(i) strike plating with copper was carried out at a current density of 20 amperes per square foot for about 2 minutes to deposit a copper second coating.

(8) Electroplating Step to Provide a Copper Third Coating

The electroplating step was carried out by an electroplating method in a copper cyanide bath under the following conditions listed below.

(i) electroplating with copper was carried out at a current density of 5 amperes per square foot for about 30 minutes to deposit a copper third coating;

(ii) drag-out; and (iii) triple rinse with deionized water at room temperature.

(9) Strike Plating Step to Provide a Silver Fourth Coating

The strike plating step was carried out by an electroplating method in a silver cyanide bath under the following conditions listed below.

(i) strike plating with silver was carried out at a current density of 9 amperes per square foot for about 20 seconds to deposit a silver fourth coating.

(10) Electroplating Step to Provide a Silver Fifth Coating

The strike plating step was carried out by an electroplating method in a silver cyanide bath under the following conditions listed below.

(i) electroplating with silver was carried out at a current density of 4.25 amperes per square foot for about 30 minutes to deposit a silver fifth coating;

(ii) double rinse with deionized water at room temperature;

(iii) a single heated rinse with deionized water at a temperature of about 68° C.; and (iv) the titanium-containing metal is allowed to air dry.

(11) Adhesion Bake

The titanium-containing metal was heated at a temperature of 125° C. for 2 hours.

EXAMPLE 2

A titanium-containing metal screw consisting of 6AL-4V-Ti alloy was plated by the following steps.

(1) Cleaning Steps (i) ultrasonic alkaline cleaning step with an aqueous ethoxylated alcohol solution (e.g., 3% v/v Cleanaire 1200™ which is commercially available from Rochester Midland) for 15 minutes at a temperature of about 60° C.;

(ii) single rinse with deionized water at room temperature;

(iii) anodic electroclean in an alkaline solution comprising sodium hydroxide, silicic acid, and carbonic acid (e.g., 62.5 g/L Electromet™ which is commercially available from Atotech) at a temperature of about 82∞C. with a current density of about 50 amperes per square foot for about 1 minute; and (iv) double rinse with deionized water at room temperature.

(2) Surface Activation Step (i) pickling in an aqueous solution containing 10.2 mol/L hydrochloric acid at room temperature for 6 minutes; and (ii) single rinse with deionized water at room temperature.

(3) Plating to Provide a Nickel First Coating

The plating step was carried out by an electroplating method in a Sulfamate bath under the following conditions listed below. The Sulfamate electrolyte bath was comprised of between about 300 g/L to about 375 g/L nickel sulfamate, about 7 g/L to 23 g/L nickel chloride, and about 30 g/L to about 45 g/L boric acid and the treatment was carried out at 49° C.

(i) plating with nickel was carried out at a first current density of 50 amperes per square foot for about 5 minutes and a second current density of 20 amperes per square foot for about 10 minutes to deposit a nickel first coating;

(iii) double rinse with deionized water at room temperature.

(4) Non-oxidative Heat Treating Step

The titanium-containing metal was heated at a temperature of 500° C. for 5 hours under a vacuum pressure of $10^{-5}$ millitor.

(5) Surface Activation Step (i) double rinse with deionized water at room temperature;

(ii) pickling in an aqueous solution containing sodium fluoride (e.g., 46 g/L Tas 3z™ which is commercially available from Technic) at room temperature for 5 minutes; and (iii) double rinse with deionized water at room temperature.

(6) Electroless Plating to Provide a Nickel Second Coating

The plating step was performed by an electroless plating method in a high phosphorus nickel bath under the following conditions listed below. The high phosphorus nickel bath was comprised of nickel phosphorous (e.g., 6 g/L of Ni via En 3500™ which is commercially available from Technic), and the treatment was carried out at 87° C.

(i) submersing the titanium-containing metal in the nickel bath for 30 minutes;

(ii) double rinse in deionized water at room temperature.

(7) Adhesion Bake

The titanium-containing metal was heated at a temperature of 125° C. for 2 hours.

(8) Cleaning Steps (i) single rinse with deionized water at room temperature;

(ii) anodic electroclean in an alkaline solution comprising sodium hydroxide, silicic acid, and carbonic acid (e.g., 3% v/v Electromet™ which is commercially available from Atotech at a temperature of about 82° C. with a current density of about 20 amperes per square foot for about 1 minute;

(iii) double rinse with deionized water at room temperature;

(iv) desmut in a conventional solution for 2 minutes at room temperature;

(v) drag-out;

(vi) double rinse with deionized water at room temperature.

(9) Surface Activation Step (i) pickling in an aqueous solution containing sodium fluoride (e.g., 46 g/L Tas 3z™ which is commercially available from Technic) at room temperature for 2 minutes;

(ii) drag-out; and (iii) double rinse with deionized water at room temperature.

(10) Strike Plating Step to Provide a Copper Third Coating

The strike plating step was carried out by an electroplating method in a copper cyanide bath under the following conditions listed below.

(i) strike plating with copper was carried out at a current density of 20 amperes per square foot for about 2 minutes to deposit a copper third coating.

(11) Electroplating Step to Provide a Copper Fourth Coating

The electroplating step was carried out by an electroplating method in a copper cyanide bath under the following conditions listed below.

(i) electroplating with copper was carried out at a current density of 5 amperes per square foot for about 30 minutes to deposit a copper fourth coating;

(ii) drag-out; and (iii) triple rinse with deionized water at room temperature.

(12) Strike Plating Step to Provide a Silver Fifth Coating

The strike plating step was carried out by an electroplating method in a silver cyanide bath under the following conditions listed below.

(i) strike plating with silver was carried out at a current density of 9 amperes per square foot for about 20 seconds to deposit a silver fifth coating.

(11) Electroplating Step to Provide a Silver Fifth Coating

The strike plating step was carried out by an electroplating method in a silver cyanide bath under the following conditions listed below.

(i) electroplating with silver was carried out at a current density of 4.25 amperes per square foot for about 30 minutes to deposit a silver fifth coating;

(ii) double rinse with deionized water at room temperature;

(iii) a single heated rinse with deionized water at a temperature of about 68° C.; and (iv) the titanium-containing metal is allowed to air dry.

(12) Adhesion Bake

The titanium-containing metal was heated at a temperature of 125° C. for 2 hours.

While the above description constitutes the preferred embodiments, it will be appreciated that the present invention is susceptible to modification and change without departing from the fair meaning of the proper scope of the accompanying claims.

What is claimed is:

1. A method for plating a titanium-containing metal, comprising the steps of:

(a) surface treating the titanium-containing metal in a solution consisting essentially of an aqueous solvent and hydrochloric acid for a period of time sufficient to activate the surface of the titanium-containing metal;

(b) plating the surface of the surface treated titanium-containing metal with a metallic coating in an electrolyte bath by applying a first voltage to impart a first electric current for a first period of time sufficient to plate a thin metallic coating onto the surface of the surface treated titanium-containing metal followed by applying a second voltage, lower than the first voltage, to impart a second electric current for a second period of time, longer than the first period of time, sufficient to build up the thickness of the thin metallic coating to a desired thickness; and (c) non-oxidatively heat treating the plated titanium-containing metal for a period of time sufficient to cause diffusion bonding between the metallic coating and the titanium-containing metal.

2. A method according to claim 1, wherein the solution in step (a) consists essentially of water and about 5 mol/L to about 15 mol/L hydrochloric acid.

3. A method according to claim 2, wherein the solution in step (a) consists essentially of water and about 10.2 mol/L hydrochloric acid.

4. A method according to claim 1, wherein the first electric current results in a first current density of between about 40 amperes per square foot to about 55 amperes per square foot at the surface of the titanium-containing metal for a first period of time from about 3 minutes to about 6 minutes followed by the second electric current that results in a second current density of about 15 amperes per square foot to about 25 amperes per square foot at the surface of the titanium-containing metal for a second period of time from about 15 minutes to about 35 minutes.

5. A method according to claim 4, wherein the first electric current results in a first current density of about 50 amperes per square foot at the surface of the titanium-containing metal and the first period of time is about 5 minutes followed by the second electric current that results in a second current density of about 20 amperes per square foot at the surface of the titanium-containing metal and the second period of time is about 25 minutes.

6. A method according to claim 1, wherein the plated titanium containing metal is non-oxidatively heat treated in step (c) at a temperature of about 300° C. to about 700° C. and wherein the period of time in step (c) is from about 1 hour to about 16 hours.

7. A method according to claim 6, wherein the plated titanium-containing metal is non-oxidatively heat treated in step (c) at a temperature of about 500° C. and wherein the period of time in step (c) is about 5 hours.

8. A method according to claim 1, further comprising the step of applying an outer metallic coating onto the surface of the non-oxidatively heat treated titanium-containing metal.

9. A method for plating a titanium-containing metal, comprising the steps of:

(a) surface treating the titanium-containing metal in a solution consisting essentially of an aqueous solvent, hydrochloric acid, and fluoboric acid for a period of time sufficient to activate the surface of the titanium-containing metal;

(b) plating the surface of the surface treated titanium-containing metal with a metallic coating in an electrolyte bath by applying a first voltage to impart a first electric current for a first period of time sufficient to plate a thin metallic coating onto the surface of the surface treated titanium-containing metal followed by applying a second voltage, lower than the first voltage, to impart a second electric current for a second period of time, longer than the first period of time, sufficient to build up the thickness of the thin metallic coating to a desired thickness; and (c) non-oxidatively heat treating the plated titanium-containing metal for a period of time sufficient to cause diffusion bonding between the metallic coating and the titanium-containing metal.

10. A method according to claim 9, wherein the solution in step (a) consists essentially of water, about 7.1 mol/L to about 9.7 mol/L hydrochloric acid, and about 0.5 mol/L to about 3.1 mol/L fluoboric acid.

11. A method according to claim 10, wherein the solution in step (a) consists essentially of water, about 8.1 mol/L hydrochloric acid and about 2.1 mol/L fluoboric acid.

12. A method according to claim 9, wherein the first electric current results in a first current density of between about 40 amperes per square foot to about 55 amperes per square foot at the surface of the titanium-containing metal for a first period of time from about 3 minutes to about 6 minutes followed by the second electric current that results in a second current density of about 15 amperes per square foot to about 25 amperes per square foot at the surface of the titanium-containing metal for a second period of time from about 15 minutes to about 35 minutes.

13. A method according to claim 12, wherein the first electric current results in a first current density of about 50 amperes per square foot at the surface of the titanium-containing metal and the first period of time is about 5 minutes followed by the second electric current that results in a second current density of about 20 amperes per square foot at the surface of the titanium-containing metal and the second period of time is about 25 minutes.

14. A method according to claim 9, wherein the plated titanium containing metal is non-oxidatively heat treated in step (c) at a temperature of about 300° C. to about 700° C. and wherein the period of time in step (c) is from about 1 hour to about 16 hours.

15. A method according to claim 14, wherein the plated titanium-containing metal is non-oxidatively heat treated in step (c) at a temperature of about 500° C. and wherein the period of time in step (c) is about 5 hours.

16. A method according to claim 9, further comprising the step of applying an outer metallic coating onto the surface of the non-oxidatively heat treated titanium-containing metal.

17. A method for plating a titanium-containing metal, comprising the steps of:

(a) surface treating the titanium-containing metal in a solution for a period of time sufficient to activate the surface of the titanium-containing metal;

(b) plating the surface of the surface treated titanium-containing metal with a first metallic coating in a first electrolyte bath;

(c) non-oxidatively heat treating the first plated titanium-containing metal for a period of time sufficient to cause diffusion bonding between the first metallic coating and the titanium-containing metal;

(d) electroless plating the non-oxidatively heat treated titanium-containing metal with a second metallic coating in a second electrolyte bath; and (e) heat treating the second plated titanium-containing metal for a period of time sufficient to promote adhesion between the second metallic coating and the first metallic coating.

18. A method according to claim 17, wherein the plating in step (b) is performed by applying a first voltage to impart a first electric current for a first period of time followed by a second voltage to impart a second electric current for a second period of time under conditions sufficient to deposit the metallic coating to a desired thickness.

19. A method according to claim 18, wherein the first electric current results in a first current density of between about 30 amperes per square foot to about 80 amperes per square foot at the surface of the titanium-containing metal for a first period of time from about 2 minutes to about 10 minutes followed by the second electric current that results in a second current density of about 5 amperes per square foot to about 35 amperes per square foot at the surface of the titanium-containing metal for a second period of time from about 5 minutes to about 20 minutes.

20. A method according to claim 19, wherein the first electric current results in a first current density of between about 50 amperes per square foot at the surface of the titanium-containing metal and the first period of time is about 5 minutes followed by the second electric current that results in a second current density of about 20 amperes per square foot at the surface of the titanium-containing metal and the second period of time is about 10 minutes.

21. A method according to claim 17, wherein the first plated titanium containing metal is non-oxidatively heat treated in step (c) at a temperature of about 300° C. to about 700° C. and wherein the period of time in step (c) is from about 1 hour to about 16 hours.

22. A method according to claim 21, wherein the first plated titanium-containing metal is non-oxidatively heat treated in step (c) at a temperature of about 500° C. and wherein the period of time in step (c) is about 5 hours.

23. A method according to claim 17, wherein the step of electroless plating in step (d) is performed by submersing the non-oxidatively heat treated titanium-containing metal into the second electrolyte bath under conditions and for a selected period of time sufficient to deposit the second metallic coating to a desired thickness.

24. A method according to claim 23, wherein the selected period of time is about 10 minutes to about 60 minutes.

25. A method according to claim 24, wherein the selected period of time is about 30 minutes.

26. A method according to claim 17, wherein the heat treating in step (e) is performed at a temperature of about 100° C. to about 500° C. and wherein the period of time in step (e) is from about 1 hour to about 4 hours.

27. A method according to claim 26, wherein the heat treating in step (e) is performed at a temperature of 125° C. for about 2 hours.

28. A method according to claim 17, further comprising the step of applying an outer metallic coating onto the surface of the heat treated titanium-containing metal.

29. A method according to claim 28, wherein the outer metallic coating comprises silver.

30. A method according to claim 17, wherein the solution in step (a) consists essentially of an aqueous solvent and hydrochloric acid.

31. A method according to claim 30, wherein the solution in step (a) consists essentially of water and about 5 mol/L to about 15 mol/L hydrochloric acid.

32. A method according to claim 31, wherein the solution in step (a) consists essentially of water and about 10.2 mol/L hydrochloric acid.

33. A method according to claim 17, wherein the solution in step (a) consists essentially of an aqueous solvent, hydrochloric acid, and fluoboric acid.

34. A method according to claim 33, wherein the solution in step (a) consists essentially of water, about 7.1 mol/L to about 9.7 mol/L hydrochloric acid, and about 0.5 mol/L to about 3.1 mol/L fluoboric acid.

35. A method according to claim 34, wherein the solution in step (a) consists essentially of water, about 8.1 mol/L hydrochloric acid and about 2.1 mol/L fluoboric acid.

* * * * *